US009705252B2

(12) United States Patent
Goto et al.

(10) Patent No.: US 9,705,252 B2
(45) Date of Patent: Jul. 11, 2017

(54) CONNECTOR

(71) Applicant: Yazaki Corporation, Minato-ku, Tokyo (JP)

(72) Inventors: Tatsuya Goto, Kakegawa (JP); Hiroaki Imai, Kakegawa (JP)

(73) Assignee: Yazaki Corporation, Minato-ku, Tokyo (JP)

( * ) Notice: Subject to any disclaimer, the term of this patent is extended or adjusted under 35 U.S.C. 154(b) by 0 days.

(21) Appl. No.: 15/163,844

(22) Filed: May 25, 2016

(65) Prior Publication Data

US 2016/0268736 A1 Sep. 15, 2016

Related U.S. Application Data

(63) Continuation of application No. PCT/JP2014/084708, filed on Dec. 26, 2014.

(30) Foreign Application Priority Data

Dec. 26, 2013 (JP) ..... 2013-270494

(51) Int. Cl.
*H01R 13/631* (2006.01)
*H01R 13/6581* (2011.01)
(Continued)

(52) U.S. Cl.
CPC ..... *H01R 13/6315* (2013.01); *H01R 13/6581* (2013.01); *H01R 13/6591* (2013.01); *H01R 13/748* (2013.01); *H01R 2107/00* (2013.01)

(58) Field of Classification Search
CPC . H01R 13/625; H01R 13/623; H01R 13/6315
(Continued)

(56) References Cited

U.S. PATENT DOCUMENTS 4,026,623 A * 5/1977 Goodman ..... H01R 13/193 439/261
5,201,625 A * 4/1993 Takenouchi ..... H01R 13/6215 411/369
(Continued)

FOREIGN PATENT DOCUMENTS

JP H06-302356 A 10/1994
JP 2002-260775 A 9/2002
(Continued)

OTHER PUBLICATIONS

Mar. 24, 2015—Written Opinion—App PCT/JP2014/084708.
Mar. 24, 2015—International Search Report—Intl App PCT/JP2014084708.

*Primary Examiner* — Ross Gushi
(74) *Attorney, Agent, or Firm* — Banner & Witcoff, Ltd.

(57) ABSTRACT

A connector includes connector terminals having elastically deformable contact portions to be contacted with device terminals of a connection counterpart side device, a housing to which the connector terminals are assembled, a rotary member that is rotatable with respect to the housing, and a motion direction conversion mechanism that converts a rotary motion of the rotary member to a linear motion to move the housing in a direction of a rotation axis of the rotary member and brings the contact portions in pressure contact with the device terminals. As the motion direction conversion mechanism, at least one protrusion is formed on one of an outer peripheral surface of a cylindrical portion of the housing and the rotary member and at least one helical groove engaging with the protrusion is formed on the other thereof.

6 Claims, 11 Drawing Sheets

(51) Int. Cl.
*H01R 13/6591* (2011.01)
*H01R 13/74* (2006.01)
*H01R 107/00* (2006.01)

(58) Field of Classification Search
USPC ..... 439/372
See application file for complete search history.

(56) References Cited

U.S. PATENT DOCUMENTS 5,368,496 A * 11/1994 Ranalletta ..... A61N 7/00 439/261
5,376,016 A * 12/1994 Inaba ..... H01R 13/6215 439/357
5,505,632 A 4/1996 Hayashi et al.
5,720,624 A * 2/1998 Ikeda ..... H01R 13/6215 439/364
5,800,197 A * 9/1998 Hyzin ..... H01R 13/639 439/372
5,993,255 A * 11/1999 Yurko ..... H01R 13/631 439/364
6,120,313 A * 9/2000 Luich ..... H01R 13/62933 439/362
6,811,417 B2 * 11/2004 Itoh ..... H01R 13/5219 439/157
6,896,535 B2 * 5/2005 Yamada ..... H01R 12/714 439/289
7,147,504 B2 * 12/2006 Ikeya ..... H01R 13/6215 439/364
7,306,472 B2 12/2007 Matsumoto et al.
7,326,090 B2 * 2/2008 Cayzac ..... H01R 13/6453 439/378
7,625,229 B2 * 12/2009 Cross ..... H01R 13/512 439/468
7,749,016 B2 * 7/2010 Ikeya ..... H01R 13/621 439/364
8,696,373 B2 * 4/2014 Yagome ..... H01R 13/62944 439/310
8,911,245 B2 * 12/2014 Okamoto ..... H01R 13/62944 439/157
9,496,643 B2 * 11/2016 Kato ..... H01R 13/623
2007/0123080 A1 5/2007 Matsumoto et al.
2016/0268733 A1 * 9/2016 Kato ..... H01R 13/631
2016/0268736 A1 * 9/2016 Goto ..... H01R 13/6581

FOREIGN PATENT DOCUMENTS

JP 2007-149462 A 6/2007
JP 2011-018579 A 1/2011

* cited by examiner

CONNECTOR

CROSS REFERENCE TO RELATED APPLICATION

This application is a continuation of PCT application No. PCT/JP2014/084708, which was filed on Dec. 26, 2014 based on Japanese Patent Application (No. 2013-270494) filed on Dec. 26, 2013, the contents of which are incorporated herein by reference. Also, all the references cited herein are incorporated as a whole.

BACKGROUND

1. Technical Field

The present invention relates to a connector for electrically connecting a plurality of terminals together, and more specifically, to a connector that enables reduction in the insertion load when device terminals are fitted to a plurality of connector terminals.

2. Description of the Related Art

As a connector structure for electrically connecting terminals together, for example, a structure is known in which two bus bar terminals each having a bolt hole are placed one on another in such a manner that the bolt holes thereof communicate with each other and these bus bar terminals are fastened by a bolt inserted through such bolt holes (hereinafter, referred to as first conventional structure). In the first conventional structure, it is necessary to place the two bus bar terminals one on another in such a manner that the formed bolt holes communicate with each other and fasten them by inserting a bolt into the communicating bolt holes. Therefore, when a plurality of pairs of bus bar terminals are connected, since it is necessary to make all the bolt holes of the bus bar terminals to be connected communicate with each other and then, fasten the bolts inserted in the communicating bolt holes a plurality of number of times, the work is cumbersome, and this is liable to lead to deterioration in the assemblability and productivity of the connector.

Therefore, as a connector structure connecting terminals together without such bolting, a structure in which male and female terminals are fitted together (hereinafter, referred to as second conventional structure) is also widely used. In the second conventional structure, a male terminal is inserted into a female terminal and a contact spring contained in the female terminal is pressed against the contact of the male terminal, thereby electrically connecting these terminals. Since bolting for connecting the terminals together is unnecessary for this reason, it is necessary to insert the male terminal into the female terminal against the pushing force (spring reaction force) of the contact spring while making the contact of the male terminal abut on the contact spring of the female terminal when the terminals are connected, and this requires a predetermined insertion force. Consequently, when a plurality of male and female terminals are simultaneously connected, since the pushing forces of the contact springs are superimposed, the insertion force increases accordingly, and this is liable to lead to deterioration in the assemblability and productivity of the connector as in the first conventional structure.

To reduce such an insertion force, for example, a connector structure is disclosed in JP-A-2011-18579 in which two bus bar terminals are previously placed one on another into a temporary contact state, these bus bar terminals are sandwiched by a contact spring provided on a movable block member and a plurality of pairs of bus bar terminals are simultaneously connected. According to such a connector structure, by pushing the block member with a bolt toward the bus bar terminals placed one on another, the contact spring advances to such bus bar terminals together with the block member against the pushing force of the contact spring and sandwiches them, so that the condition changes from the temporary contact condition to a contact condition of being pressed by the contact spring and these terminals are electrically connected.

However, in the connector structure disclosed in JP-A-2011-18579, it is necessary to previously insert the connecting side connector into the connected side connector so that the bus bar terminals of the connecting side and connected side connectors are placed one on another into the temporary contact state, so that if the number of bus bar terminals to be brought into the temporary contact state is increased, the insertion work is still complicated accordingly. Moreover, it is necessary to situate the movable block member where a plurality of contact springs are provided, on the connecting side connector in consideration of the pushing forces of the contact springs. Therefore, not only the number of parts increases but it is necessary to structure the connector in consideration of the adjustment of the pushing forces of the contact springs as well.

SUMMARY

The present invention is made in light of this, and a problem to be solved thereby is to provide a connector capable of simultaneously achieving reduction in terminal insertion load and improvement in workability with a comparatively simple structure even when a plurality of terminals are connected together.

To solve the above-mentioned problem, a connector according to the present invention includes: a plurality of connector terminals having elastically deformable contact portions to be contacted with device terminals of a connection counterpart side device; a housing to which the connector terminals are assembled; a rotary member that is rotatable with respect to the housing by an external operation; and a motion direction conversion mechanism that converts a rotary motion of the rotary member to a linear motion to move the housing in a direction of a rotation axis of the rotary member and brings the contact portions of the connector terminals in pressure contact with the device terminals, wherein the housing includes a cylindrical portion which is concentric with the rotation axis of the rotary member, and as the motion direction conversion mechanism, at least one protrusion is formed on one of an outer peripheral surface of the cylindrical portion and the rotary member and at least one helical groove engaging with the protrusion is formed on the other of the outer peripheral surface of the cylindrical portion and the rotary member.

According to this, by moving the connector terminals toward the device terminals together with the housing by the motion direction conversion mechanism, the contact portions can be brought into pressure contact with the device terminals to electrically connect the connector terminals and the device terminals. Consequently, for example, even when a plurality of terminals are connected together, no other connection members than the connector terminals and the device terminals are required for each connection unit. This avoids the complication of the structure of connection between the terminals, and a plurality of terminals can be connected at a time. Moreover, for example, it is unnecessary to temporarily insert the device terminals into the connector terminals (temporarily bring them into contact with the contact portions), and even when a plurality of terminals are connected together, the labor for such temporary insertion work and temporary contact work is never increased to be complicated in accordance with the number of terminals.

In this case, a structure may be adopted in which the connector includes an exterior member that surrounds the housing and is fixed to the connection counterpart side device, on one of the housing and the exterior member, a slit linearly extending in the direction of the rotation axis is formed, and on the other of the housing and the exterior member, a boss engaging with the slit to restrict the movement of the housing in directions other than the direction of the rotation axis is formed. When the rotary member is rotated with respect to the housing, although a force (rotation force) in such a rotation direction acts also on the housing since the protrusion is engaged with the helical groove, by applying such a rotation force by the engagement between the boss and the slit, the movement of the housing in such a rotation direction can be restricted. On the other hand, such a rotation force can be absorbed (released) by moving the boss along the slit. That is, since the boss is guided along the slit while restricting the movement of the housing in directions other than the rotation axis direction, the housing can be smoothly moved in the rotation axis direction (plainly, toward the device terminals).

Moreover, in such a connector, a structure is adopted in which an operation member is provided outside the exterior member and supports the rotary member so as to be rotatable around the rotation axis. With this, the housing can be moved by rotating the rotary member by the operation member after fixing the exterior member to the connection counterpart side device and positioning the connector with respect to the connection counterpart side device. Consequently, for example, without the need to previously bring the contact portions of the female terminals into pressure contact with the male terminals (even if they are in contact, the contact is nothing to cause an excessive pressing load), the connector terminals can be easily connected to the device terminals only by rotating the operation member after the exterior member is fixed.

Moreover, for example, if a shield shell that prevents the external leakage of the noise caused from the inside of the connector is used as the exterior member, the noise such as electromagnetic waves can be grounded through the connection counterpart side device. Consequently, since the connector terminals can be electrically connected to the device terminals under a condition where the propagation due to such noise leakage is prevented, the influence of the noise on peripheral devices can be suppressed as well.

According to the present invention, a connector is realized that is capable of simultaneously achieving reduction in terminal insertion load and improvement in workability with a comparatively simple structure even when a plurality of terminals are connected together.

BRIEF DESCRIPTION OF THE DRAWINGS

FIG. 4A is a view illustrating it from above, FIG. 4B is a view illustrating it from behind, and FIG. 4C is a view illustrating it from a side.

FIG. 5A is a view illustrating it from above, FIG. 5B is a view illustrating it from behind, and FIG. 5C is a view illustrating it from a side.

FIG. 6A is a view illustrating it from above, FIG. 6B is a view illustrating it from behind, and FIG. 6C is a view illustrating it from a side.

FIG. 4A is a view from above, FIG. 4B is a view from behind, and FIG. 4C is a view from a side.

FIG. 5A is a view from above, FIG. 5B is a view from behind, and FIG. 5C is a view from a side.

FIG. 6A is a view from above, FIG. 6B is a view from behind, and FIG. 6C is a view from a side.

DETAILED DESCRIPTION OF THE EXEMPLARY EMBODIMENTS

Figure 1:
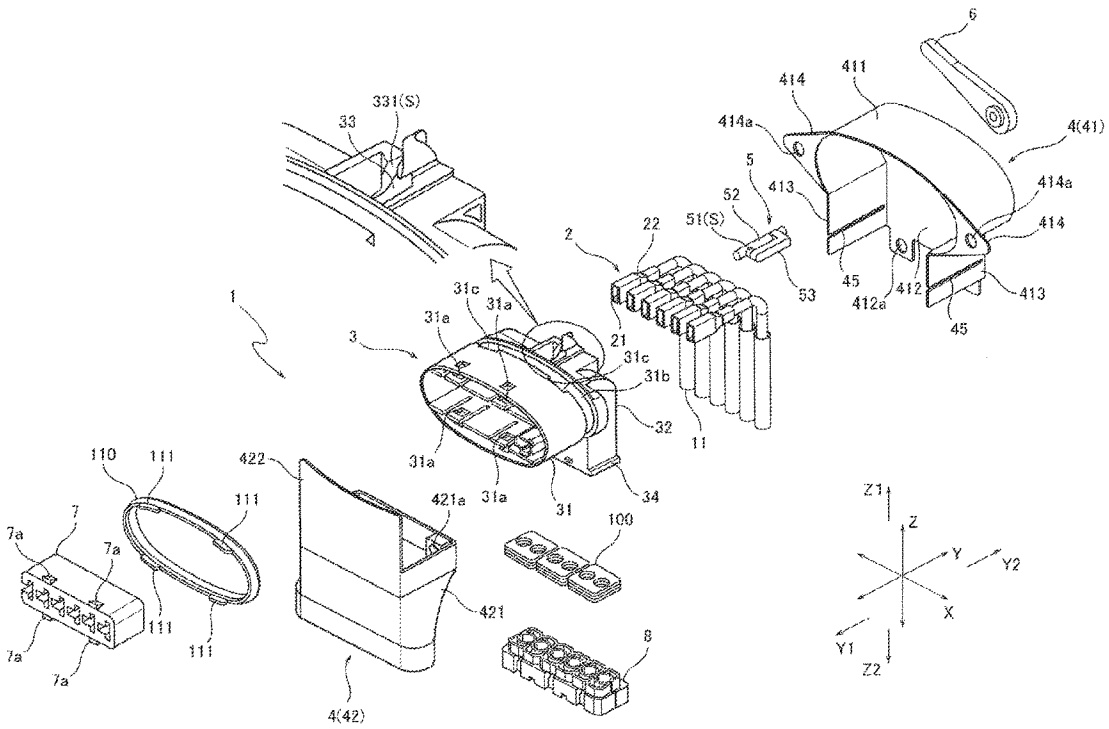
FIG. 1 is a perspective view illustrating a connector according to an embodiment of the present invention disassembled into components.
Figure 2:
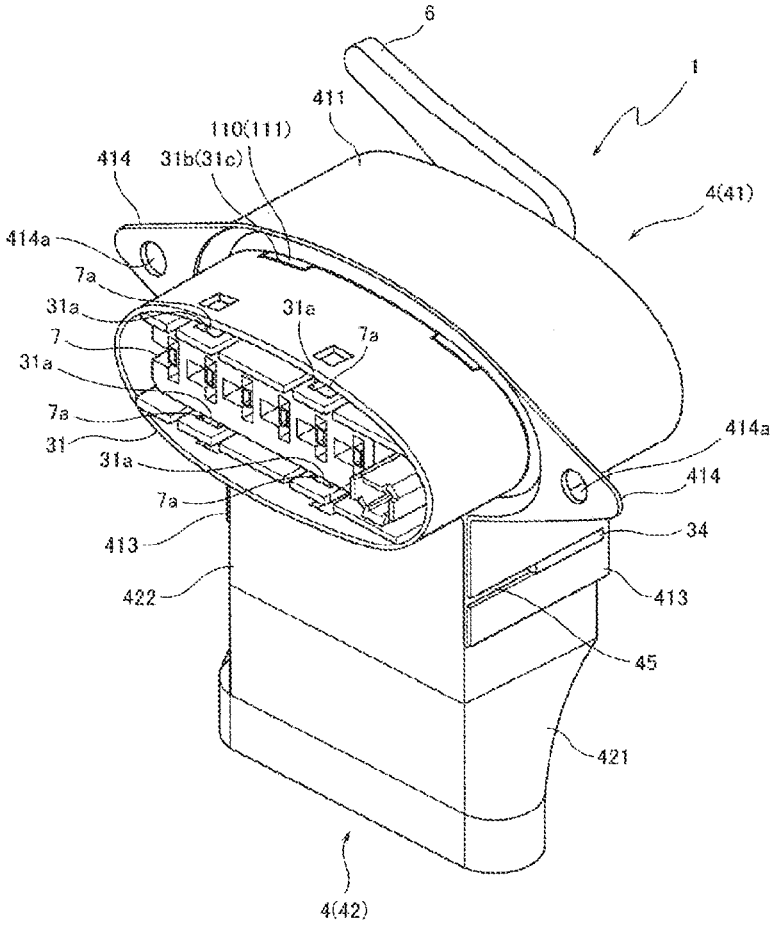
FIG. 2 is a general perspective view of the connector, illustrating a condition where the components illustrated in FIG. 1 are assembled.

Hereinafter, a connector of the present invention will be described with reference to the attached drawings. FIG. 1 and FIG. 2 show the general structure of a connector according to an embodiment of the present invention. FIG. 1 is a perspective view illustrating the connector disassembled into components, and FIG. 2 is a general perspective view illustrating a condition where the components illustrated in FIG. 1 are assembled. In the following description, the direction of the arrow X illustrated in FIG. 1 will be referred to as the right-left direction, the direction of the arrow Y, as the front-rear direction, and the direction of the arrow Z, as the up-down direction. Regarding the front-rear direction, the direction of the arrow Y1 in FIG. 1 is identified as the front side (frontward) and the direction of the arrow Y2, as the rear side (rearward), and regarding the up-down direction, the direction of the arrow Z1 in FIG. 1 is identified as the upper side (upward) and the direction of the arrow Z1, as the lower side (downward). However, it is not always necessary that these right-left direction, front-rear direction and up-down direction coincide with the directions under a condition where the connector is actually connected to a connection counterpart device.

As illustrated in FIG. 1, the connector 1 includes a plurality of connector terminals 2 each having an elastically deformable contact portion 21 that is in contact with a device terminal 9 of a connection counterpart side device 10 (see FIG. 4A to FIG. 6C), a housing 3 to which the connector terminals 2 are assembled, an exterior member 4 surrounding the housing 3 and fixed to the connection counterpart side device 10, a rotary member 5 that is rotatable with respect to the housing 3 by an external operation, and a motion direction conversion mechanism S that converts the rotary motion of the rotary member 5 to a linear motion to move the housing 3 in the direction of the rotation axis of the rotary member 5 and brings the contact portions 21 of the connector terminals 2 into pressure contact with the device terminals 9. Moreover, the connector 1 includes an operation member 6 provided outside the exterior member 4 and supporting the rotary member 5 in such a manner as to be rotatable around the rotation axis thereof. While the mode of the operation member 6 is not specifically limited as long as it enhances the rotation operability of the rotary member 5 and the present embodiment is made on the assumption that it is a lever as an example, it may be, for example, a knob form, or these may have a detachably attachable structure. Alternatively, a prismatic protrusion formed on an end portion of the rotary member, or a tool or a jig that engages with a plus or minus groove or the like to rotate the rotary member (a wrench, a spanner, a driver, etc.) may be used as the operation member.

While FIG. 1 illustrates the structure of the connector 1 provided with six connector terminals 2 attached to the end portions of six electric wires 11, respectively, the number of connector terminals 2 is not specifically limited. For example, a connector structure having five or less connector terminals may be adopted or a connector structure having seven or more connector terminals may be adopted. Although a connector structure provided with only one connector terminal is technically possible, the present invention is made on the assumption that a connector structure provided with a plurality of connector terminals is adopted. Moreover, while a structure in which the connector terminals 2 are attached to the end portions of the electric wires 11 is adopted in FIG. 1, a structure may be adopted such that the connector terminals are directly attached to contacts or the like of a circuit board. In short, it is essential only that the terminal structure be electrically connectable to the connection counterpart side device 10 having the device terminals 9. In other words, the number of device terminals 9 does not matter as long as it corresponds to the number of connector terminals 2, and it is essential that the device terminals 9 have a structure electrically connectable through the connector terminals 2 to the electronic apparatus mounted with the connector 1. Therefore, the so-called male-female relation between the connector terminals 2 and the device terminals 9 is not limited and while the connector terminals 2 are female terminals and the device terminals 9 are male terminals in the present embodiment, it may be considered that the relation is opposite thereto.

The connector terminal 2 is made of a metallic material having conductivity, and has a structure in which the contact portion 21 is electrically connected to the device terminal 9 by being elastically deformed and brought into pressure contact with the device terminal 9 by such an elastic force (pushing force). Moreover, the connector terminal 2 has a base end portion 22 supporting the contact portion 21 and connected to the end portion of the electric wire 11. In the present embodiment, while the base end portion 22 supports the contact portion 21 frontward, it is joined to the end portion in such a manner so as to extend the electric wire 11 downward. That is, in the present embodiment, the connector 1 is structured as a bent (so-called L shape) type where the connection counterpart side device 10 having the device terminals 9 is substantially orthogonally connected to the electric wires 11 to which the connector terminals 2 are attached. Thereby, the physical size of the connector 1 in the front-rear direction can be reduced, which results in a structure where a space can be secured behind the connector 1. However, the connector may be structured as a straight type where the electric wires 11 and the connection counterpart side device 10 are connected in the direction of extension of the electric wires 11.

The housing 3 has a structure in which a terminal accommodation portion 31 having a substantially elliptic cylindrical shape and an electric wire accommodation portion 32 having a substantially rectangular tubular shape are continuous substantially orthogonally. That is, in the housing 3, the terminal accommodation portion 31 is open frontward and the electric wire accommodation portion 32 is open downward so that a substantially L-shaped space is formed inside. The terminal accommodation portion 31 accommodates and holds the connector terminal 2 thereinside, and the electric wire accommodation portion 32 accommodates and holds a neighborhood of the end portion of each electric wire 11. In this case, the electric wires 11 to which the connector terminals 2 are connected are inserted from the lower opening of the electric wire accommodation portion 32 so that the contact portions 21 of the connector terminals 2 face the outside through the front opening of the terminal accommodation portion 31. The electric wires 11 accommodated and held by the electric wire accommodation portion 32 extend outward from the lower opening of the electric wire accommodation portion 32.

In the housing 3, a terminal holding member (hereinafter, referred to as inner holder) 7 is attachable to the inside of the tube of the terminal accommodation portion 31, and the six connector terminals 2 inserted in the housing 3 are held by the inner holder 7 at predetermined intervals in the right-left direction with the contact portions 21 adjoining each other. In this case, engaged holes 31*a* are formed on the terminal accommodation portion 31, and engagement protrusions 7*a* that engage with the engaged holes 31*a* are formed on the inner holder 7. This enables the inner holder 7 to be positioned and fixed to the housing 3 by engaging the engagement protrusions 7*a* with the engaged holes 31*a* while inserting the inner holder 7 into the terminal accommodation portion 31 from the front opening. That is, the connector terminals 2 are assembled to the housing 3 through the inner holder 7 positioned and fixed to the housing 3. Moreover, in the housing 3, an electric wire holding member (hereinafter, referred to as electric wire holder) 8 is attachable to the inside of the electric wire accommodation portion 32, and the six electric wires 11 connected to the six connector terminals 2 are held by the electric wire holder 8 at predetermined intervals in the right-left direction. This enables the electric wires 11 to be placed in the connector 1 while being aligned without scattering. Above the electric wire holder 8, a sealing member (as an example, a seal made of rubber or the like having six through holes) 100 is attached to the electric wires 11, thereby preventing water intrusion from below (water intrusion along the electric wires 11) to the part of connection between the electric wires 11 and the connector terminals 2.

In the housing 3, a ring-shaped sealing member (as an example, a seal made of rubber or the like having an elastic lip) 110 is attached to the rear outer peripheral portion of the terminal accommodation portion 31, thereby achieving sealing (waterproofing, dustproofing, etc.) of the inside of the housing 3 when the connection counterpart side device 10 having the device terminals 9 and the connector 1 are fitted together. In this case, the sealing member 110 has rotation prevention pieces 111, and the rotation prevention pieces 111 are fitted in fit-in portions 31*c* formed on a seal attachment groove 31*b* of the terminal accommodation portion 31 so as to interfere, thereby locking the rotation with respect to the housing 3 (the terminal accommodation portion 31).

As described above, the housing 3 accommodating and holding the connector terminals 2 and the electric wires 11 are surrounded by the exterior member 4. The exterior member 4 is fixed to the connection counterpart side device 10, and supports the housing 3 in such a manner as to be movable toward the device terminal 9 with respect to the exterior member 4. In the present embodiment, the exterior member 4 supports the housing 3 through the rotary member 5 and the operation member 6. Moreover, while in the present embodiment, as an example, the exterior member (hereinafter, referred to as shield shell) 4 is structured as a case member with conductivity also having the function of preventing the external leakage of the noise caused from the inside of the connector 1, the present invention is not specifically limited to such a structure. With such a structure, for example, the noise such as electromagnetic waves caused from the inside of the connector 1 can be grounded through the connection counterpart side device 10 to which the shield shell 4 is assembled. Consequently, since the connector terminals 2 can be electrically connected to the device terminals 9 under a condition where the propagation due to such noise leakage is prevented, the influence of the noise on peripheral devices can be suppressed as well.

The shield shell 4 has a divided structure in which a first shield shell (hereinafter, referred to as upper shield shell) 41 covering the upper part of the terminal accommodation portion 31 and the upper part, rear part, left side part and right side part of the electric wire accommodation portion 32 and a second shield shell (hereinafter, referred to as lower shield shell) 42 covering the peripheries of neighborhoods of the end portions of the electric wires 11 are assembled together so as to be united. The upper shield shell 41 has an upper wall portion 411 extending along the curve of the upper peripheral portion of the terminal accommodation portion 31, a rear wall portion 412 hanging down from the rear edge of the upper wall portion 411, side wall portions 413 hanging down along the terminal accommodation portion 31 and the electric wire accommodation portion 32 from the side portions of the upper wall portion 411 in the right-left direction, and flange portions 414 extending in the right-left direction from the front edge of the upper wall portion 411. Such an upper shield shell 41 is situated so that the upper wall portion 411 covers the upper parts of the terminal accommodation portion 31 and the electric wire accommodation portion 32 (the terminal accommodation portion 31 is a part thereof), the rear wall portion 412 covers the rear part of the electric wire accommodation portion 32 and the side wall portions 413 cover the left side part and the right side part of the terminal accommodation portion 31 and the electric wire accommodation portion 32 with a gap. On the contrary, the lower shield shell 42 has in its tube a tube portion 421 through which the electric wires 11 are inserted and a front wall portion 422 uprising from the front upper end of the tube portion 421. The upper end of the front wall portion 422 is formed in a concave shape along the curve of the lower outer peripheral portion of the terminal accommodation portion 31. Such a lower shield shell 42 is situated so that the front wall portion 422 abuts on the front end of the side wall portions 413 of the upper shield shell 41 and that the upper end of the front wall portion 422 abuts on the lower outer peripheral portion of the terminal accommodation portion 31.

Then, the upper shield shell 41 and the lower shield shell 42 are united by screwing bolts 43 inserted through through holes 412*a* formed on the rear wall portion 412 into screw holes 421*a* formed on the tube portion 421, thereby forming the shield shell 4. Such a shield shell 4 is assembled to the connection counterpart side device 10 by screwing bolts 44 inserted through through holes 414*a* formed on the flange portions 414 of the upper shield shell 41 into screw holes 10*a* formed on the connection counterpart side device 10. Thereby, the connector 1 is positioned and fixed to the connection counterpart side device 10. In this case, a hole portion 101 communicating with the device terminals 9 and capable of accommodating the terminal accommodation portion 31 of the housing 3 in such a manner that the device terminals 9 face the connector terminals 2 is formed on the connection counterpart side device 10, and the connector 1 is positioned and fixed to the connection counterpart side device 10 by the shield shell 4 being assembled to the connection counterpart side device 10 under a condition where the terminal accommodation portion 31 enters the hole portion 101 (see FIG. 4A to FIG. 6C).

Figure 7:
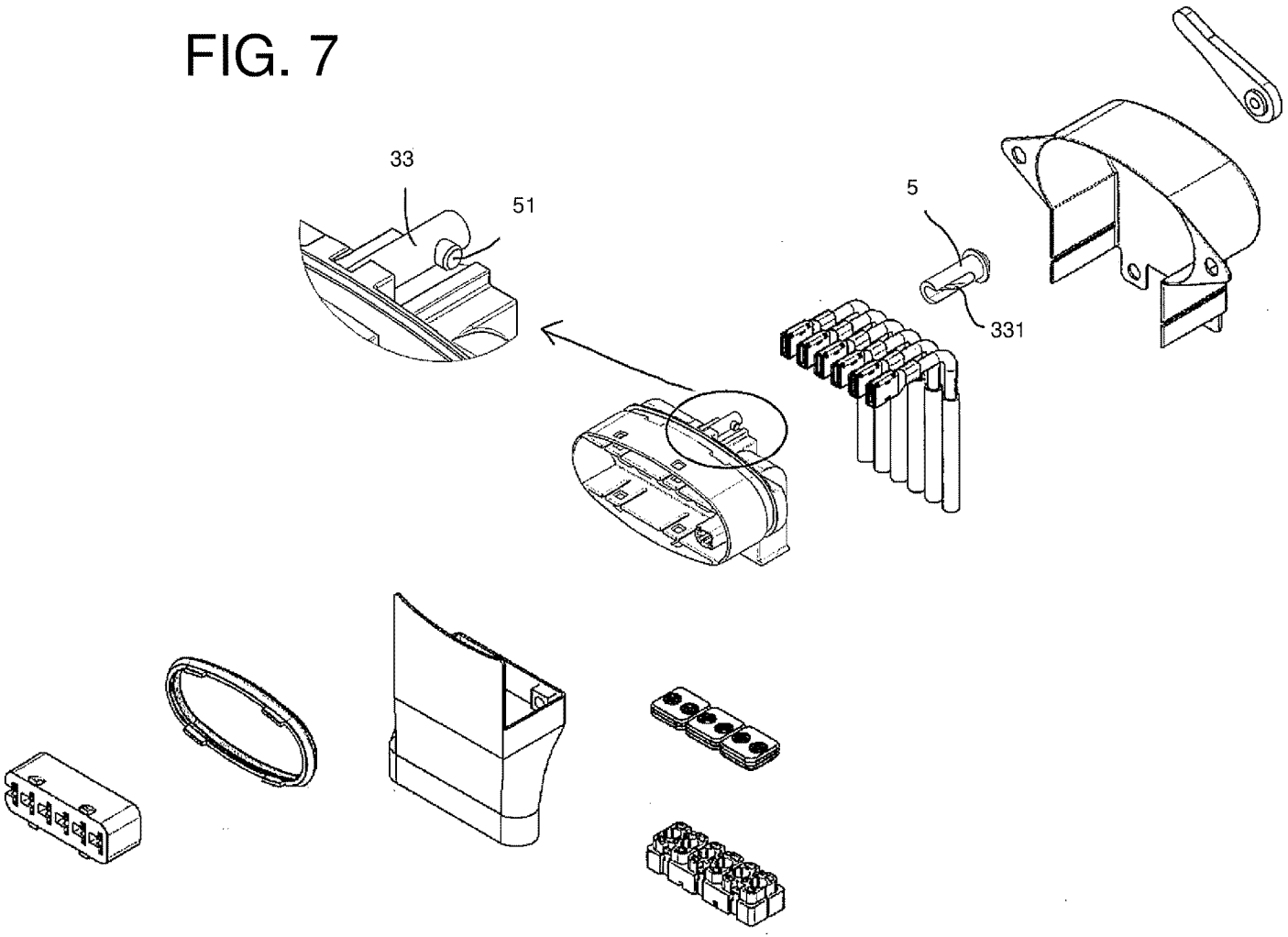
FIG. 7 is a perspective view illustrating a connector according to an alternative embodiment of the present invention disassembled into components.
Figure 8:
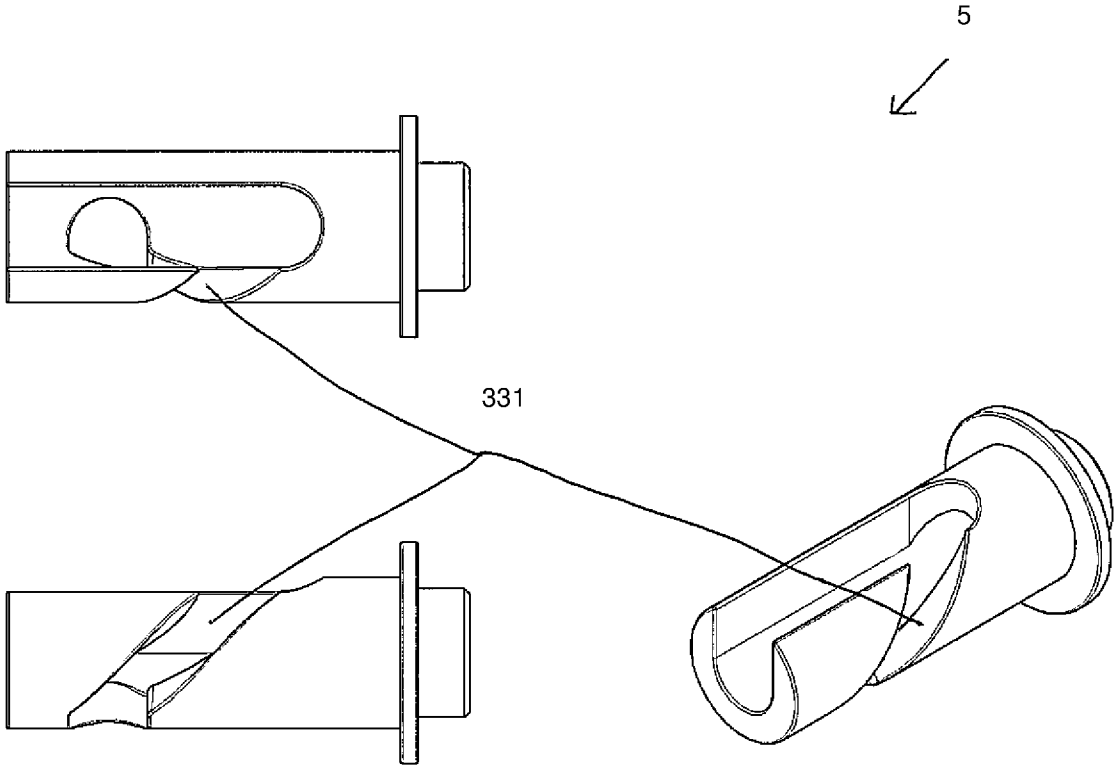
FIG. 8 is a view illustrating the structure of a rotary member according to the alternative embodiment of FIG. 7.
Figure 9A:
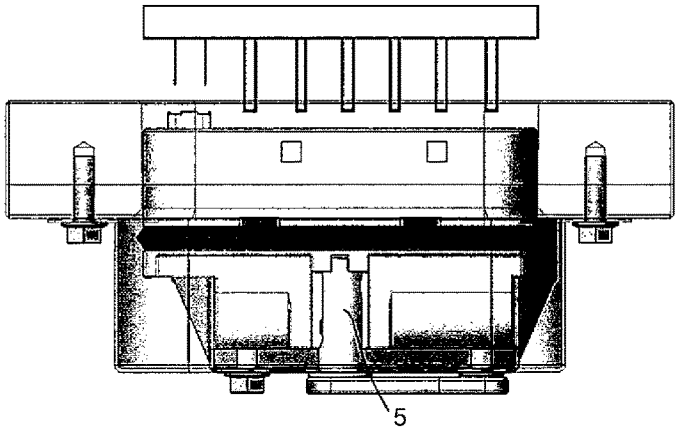
FIGS. 9A-9C are views illustrating a mode of the connector according to the alternative embodiment under a condition where a housing (a cylindrical portion) is situated in a first position and the rotary member and a lever are situated in a first rotation position (connector non-fitted condition), where
Figure 9B:
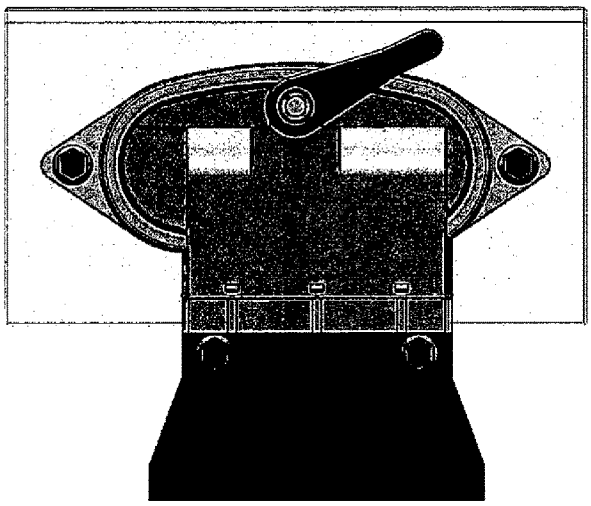
Figure 9C:
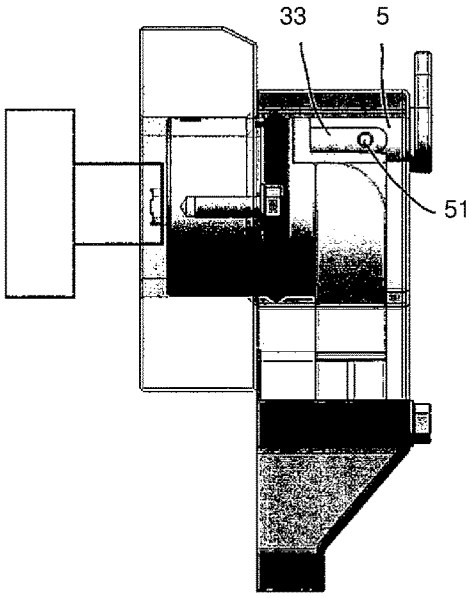
Figure 10A:
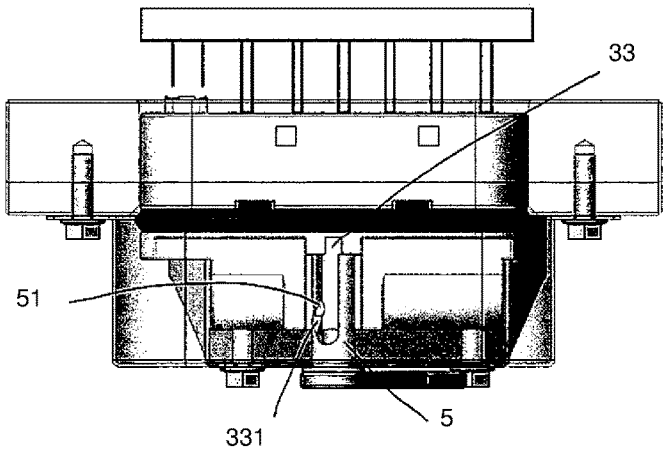
FIGS. 10A-10C are views illustrating a mode of the connector according to the alternative embodiment under a condition where the housing (the cylindrical portion) is in the middle of moving from the first position to a second position and the rotary member and the lever are in the middle of moving from the first rotation position to a second rotation position (connector fitting condition), where
Figure 10B:
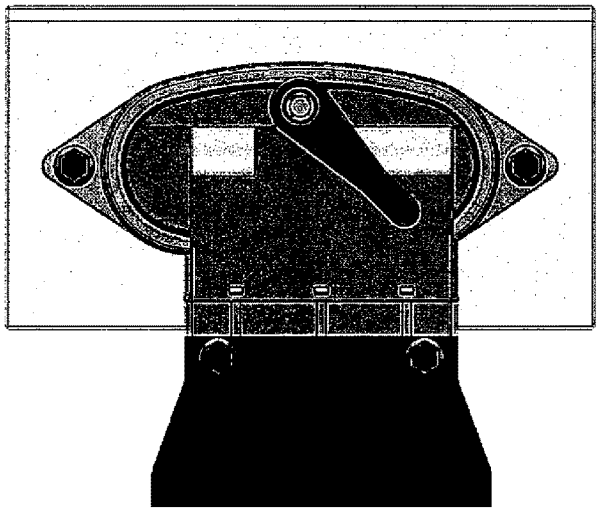
Figure 10C:
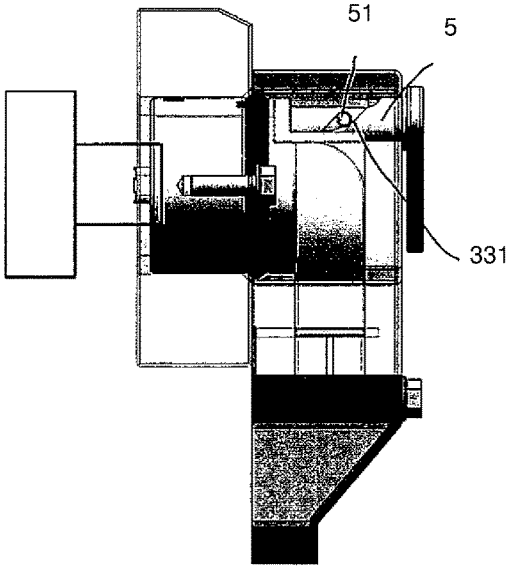
Figure 11A:
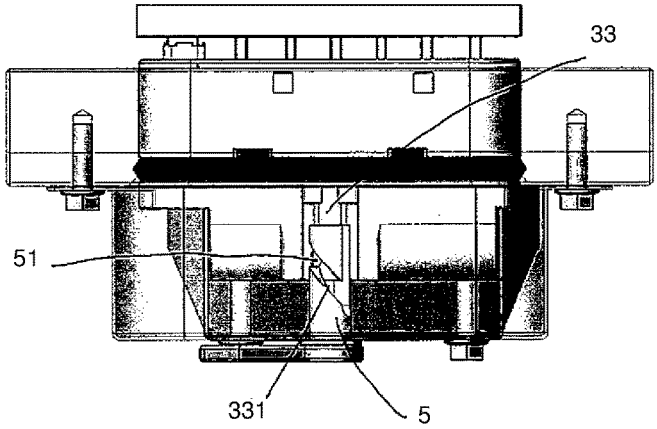
FIGS. 11A-11C are views illustrating a mode of the connector according to the alternative embodiment under a condition where the housing (the cylindrical portion) is situated in the second position and the rotary member and the lever are situated in the second rotation position (connector fitted condition), where
Figure 11B:
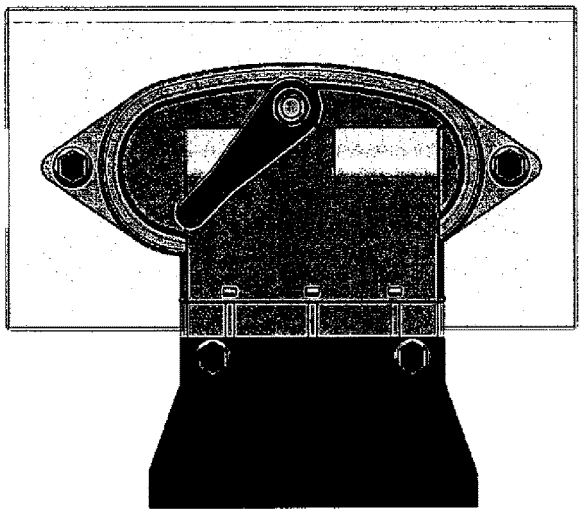
Figure 11C:
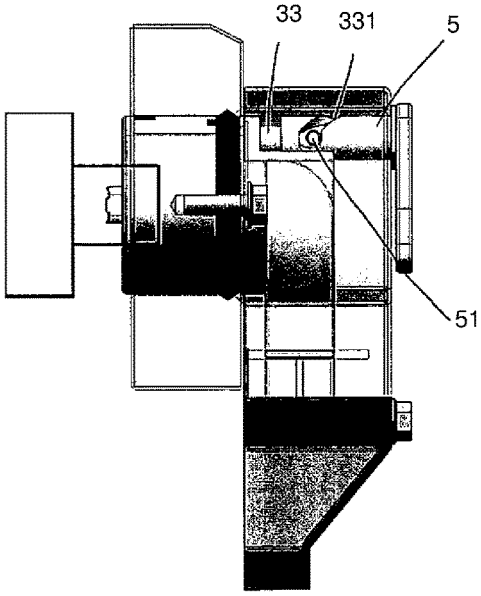

In the present embodiment, the housing 3 has a cylindrical portion 33 that is concentric with the rotation axis (axis along the front-rear direction) of the rotary member 5. In this case, the cylindrical portion 33 is provided substantially in the center in the right-left direction in an upper part of the electric wire accommodation portion 32, and protrudes rearward more than the terminal accommodation portion 31. As the motion direction conversion mechanism S in another embodiment, at least one protrusion 51 is formed on one of the outer peripheral surface of the housing 3 and the rotary member 5, whereas at least one helical groove 331 engaging with the protrusion 51 is formed on the other thereof. Such an embodiment is illustrated in FIGS. 7 and 8. Such a protrusion 51 moves the cylindrical portion 33 of the housing 3 from a first position to a second position in the direction of the rotation axis of the rotary member 5 (front-rear direction) when the rotary member 5 is rotated from a first rotation position (as shown in FIGS. 9A-9C) to a second rotation position (as shown in FIGS. 11A-11C). That is, in the connector 1 according to the present embodiment, a rotary motion of the rotary member 5 around the rotation axis is converted to a linearly reciprocating motion in the direction of the rotation axis of the cylindrical portion 33 of the housing 3 by the motion direction conversion mechanism S (the protrusion 51 and the helical groove 331). FIGS. 10A-10C illustrate an intermediary rotation position, between the first and second positions, of the rotary member 5.

By such a motion direction conversion mechanism S, in the first position, the connector terminals 2 separate from the device terminals 9 together with the housing 3 to release the pressure contact of the contact portions 21 with the device terminals 9, and in the second position, the connector terminals 2 approach the device terminals 9 together with the housing 3 to bring the contact portions 21 into pressure contact with the device terminals 9. In other words, the first position and the corresponding first rotation position are set to positions where the housing 3 separates the contact portions 21 of the connector terminals 2 from the device terminals 9 to release the pressure contact. Moreover, the second position and the corresponding second rotation position are set to positions where the housing 3 brings the contact portions 21 of the connector terminals 2 near to the device terminals 9 to be in pressure contact therewith to thereby electrically connect them. Thereby, when the rotary member 5 is rotated from the first rotation position to the second rotation position around the rotation axis (hereinafter, referred to as normal rotation) by operating the operation member (lever) 6, the protrusion relatively moves along the helical groove to move the cylindrical portion 33 from the first position to the second position forward with respect to the shield shell 4. Since the shield shell 4 is fixed to the connection counterpart side device 10, the housing 3 approaches the device terminals 9 together with the connector terminals 2 in the hole portion 101 of the connection counterpart side device 10, and the connector terminals 2 with the contact portions 21 being brought into pressure contact with the device terminals 9 are electrically connected to the device terminals 9. On the other hand, when the rotary member 5 is rotated from the second rotation position to the first rotation position around the rotation axis (hereinafter, referred to as reverse rotation) by a lever operation, the protrusion relatively moves along the helical groove to cause the cylindrical portion 33 to retreat from the second position to the first position rearward with respect to the shield shell 4. As a consequence, the housing 3 separates from the device terminals 9 together with the connector terminals 2 in the hole portion 101, and the connector terminals 2 release the pressure contact of the contact portions 21 with the device terminals 9 and also release the electrical connection with the device terminals 9.

In the motion direction conversion mechanism S according to the present embodiment, as an example, one protrusion 51 is formed on the rotary member 5 and one helical groove (so-called thread groove) 331 engaging with the protrusion 51 is formed on the outer peripheral surface of the cylindrical portion 33. However, a structure may be considered in which conversely thereto, a helical groove is formed on the rotary member 5 and a protrusion is formed on the outer peripheral surface of the cylindrical portion 33. Moreover, a structure may be adopted in which these protrusion and helical groove are formed two or more in number so as to be engageable with each other.

Figure 3:
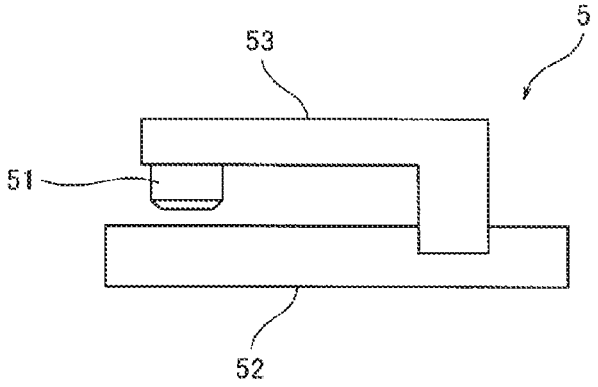
FIG. 3 is a view illustrating the structure of a rotary member.

As illustrated in FIG. 3, the rotary member 5 has a rotation axis portion 52 serving as the rotation center axis and an arm portion 53 that rotates around the rotation axis portion 52. The rotation axis portion 52 is formed in a bar shape that is circular in cross section, the front part thereof is inserted in a hole portion (not illustrated) formed in the center of the cylindrical portion 33 so as to be rotatable inside it, and the rear part thereof is exposed to the outside from a through hole 412*b* formed on the rear wall portion 412 of the upper shield shell 41 and the lever 6 is attached thereto. In this case, the rotation axis portion 52 is out of contact with or loosely fitted on the inner periphery of the through hole 412*b*, and can be rotated normally by rotating the lever 6 in the normal direction, (reversely by rotating it in the reverse direction). The arm portion 53 uprises from a rear part of the rotation axis portion 52 in the diameter increasing direction (radial direction), bends frontward and extends to nearly the front end of the rotation axis portion 52, and the protrusion 51 is formed substantially in a cylindrical shape from a neighborhood of the extension end in the diameter decreasing direction (toward the rotation axis portion 52). The height of uprise of the arm portion 53 from the rotation axis portion 52 and the height of protrusion of the protrusion 51 are set so that relative movement along the helical groove 331 is possible by engagement with the helical groove 331 formed on the outer peripheral surface of the cylindrical portion 33 under a condition where the rotation axis portion 52 is inserted in the cylindrical portion 33.

The helical groove 331 has its depth and width set so as to be slightly larger than the protrusion height and protrusion width (radial dimension) of the protrusion 51 and is formed so as to range with the outer peripheral surface of the cylindrical portion 33. Moreover, the helical groove 331 has a restriction groove 331*b* communicating with the rear end of a groove (groove that relatively moves the protrusion 51 [hereinafter, referred to as track groove 331*a*]), being parallel to the circumferential direction of the cylindrical portion 33 and restricting the relative movement of the protrusion 51 in the front-rear direction. In this case, the restriction groove 331*b* has the same configuration as the track groove 331*a* and communicates with the rear end of the track groove 331*a*. Thereby, the restriction groove 331*b* restricts a further movement of the protrusion 51 having relatively moved along the track groove 331*a*. Specifically, the function as a stopper that stops the advance and retreat of the housing 3 (the connector terminals 2) with respect to the device terminals 9 by causing the protrusion 51 to abut on the groove wall is performed by a restriction groove 60*b*. In other words, the rotation position (rotation condition) of the rotary member 5 under a condition where the protrusion 51 is engaged with the restriction groove 331*b* and the position in the rotation axis direction (the front-rear direction) of the cylindrical portion 33 (the housing 3) correspond to the second rotation position and the second position, and the restriction groove 331*b* serves as a stopper that restricts the movement of the protrusion 51 in the front-rear direction in the second position (the second rotation position). In addition to the restriction groove 331*b*, a restriction groove communicating with the front end of the track groove 331*a* may be formed so as to serve as a stopper that restricts the movement of the protrusion 51 in the rotation axis direction (the front-rear direction) in the first position (the first rotation position). In other words, in this case, the rotation position (rotation condition) of the rotary member 5 under a condition where such a restriction groove and the protrusion 51 are engaged with each other and the position in the rotation axis direction (the front-rear direction) of the cylindrical portion 33 (the housing 3) correspond to the first rotation position and the first position.

Moreover, in the present embodiment, on one of the housing 3 and the shield shell 4, a slit linearly extending in the rotation axis direction (the front-rear direction) is formed, and on the other thereof, a boss engaging with the slit to restrict the movement of the housing 3 in directions other than the rotation axis direction. As an example, FIG. 1 and FIG. 2 show a structure in which slits 45 are formed on the shield shell 4 and bosses 34 are formed on the housing 3. However, a structure can be considered in which conversely thereto, a slit is formed on the housing 3 and a boss is formed on the shield shell 4. Moreover, a structure may be adopted in which these slit and boss are formed two or more in number so as to be engageable with each other.

The bosses 34 are formed so that both the left side portion and right side portion of the electric wire accommodation portion 32 protrude outward from the lower end. In this case, the bosses 34 continue over the entire length (dimension in the front-rear direction) of the lower end of the right and left side portions of the electric wire accommodation portion 32. The bosses 34 are not limited to the structure in which they continue over the entire width as described above; for example, they may have a structure in which they are intermittently distributed over the entire width (structure in which they are not continuous but are partly missing).

The slits 45 are formed below intermediate parts in the up-down direction of a pair of side wall portions 413 of the upper shield shell 41. In this case, the slits 45 are continuous over the entire length (dimension in the front-rear direction) of the pair of side wall portions 413. The front ends of the slits 45 are free ends, and the bosses 34 can be inserted into the slits 45 from the free ends. On the other hand, the rear ends of the slits 45 are fixed ends, and the bosses 34 inserted in the slits 45 abut against it. The configuration and disposition of the slits 45 are not specifically limited as long as the bosses 34 can be engaged therewith. In short, it is essential only that the bosses 34 and the slits 45 be formed in the configuration and disposition associated so that they are engageable with each other. Moreover, the width (dimension in the up-down direction) of the slits 45 is set so as to be slightly larger than the protrusion width (dimension in the up-down direction) of the bosses 34.

When the protrusion 51 relatively moves along the helical groove 331 in a case where the rotary member 5 is rotated normally (or reversely), a force (rotation force) in the normal direction (or the reverse direction) acts on the housing 3. In that case, since the bosses 34 of the housing 3 are engaged with the slits 45 of the shield shell 4 and the shield shell 4 is fixed to the connection counterpart side device 10, the movement of the housing 3 in the normal direction (or the reverse direction) can be restricted. On the other hand, such a rotation force can be absorbed (released) by moving the bosses 34 along the slits 45. That is, by forming the bosses 34 and the slits 45, the movement of the housing 3 in directions other than the rotation axis direction (the front-rear direction) can be restricted. Moreover, since the bosses 34 are guided along the slits 45, the housing 3 can be smoothly moved in the rotation axis direction (the front-rear direction). That is, the slits 45 function as the guide portions that move the housing 3 in the rotation axis direction. In this case, the bosses 34 engage on the side close to the rear of the slits 45 under a condition where the housing 3 is situated in the first position (a position where the housing 3 separates the contact portions 21 of the connector terminals 2 from the device terminals 9 to release the pressure contact) (see FIGS. 4A to 4C). In that case, the bosses 34 abut against the rear ends (fixed ends) of the slits 45, thereby restricting the movement of the housing 3 (the connector terminals 2) further rearward from the first position (the retreat thereof from the device terminals 9). Moreover, the bosses 34 engage on the side close to the front of the slits 45 under a condition where the housing 3 is situated in the second position (a position where the housing 3 brings the contact portions 21 of the connector terminals 2 close to the device terminals 9 to be in pressure contact therewith) (see FIGS. 6A to 6C). In that case, the protrusion 51 abuts against the groove wall of the restriction groove 331*b* as described above, thereby restricting the movement of the housing 3 (the connector terminals 2) further frontward from the second position (the advance toward the device terminals 9).

Figure 4A:
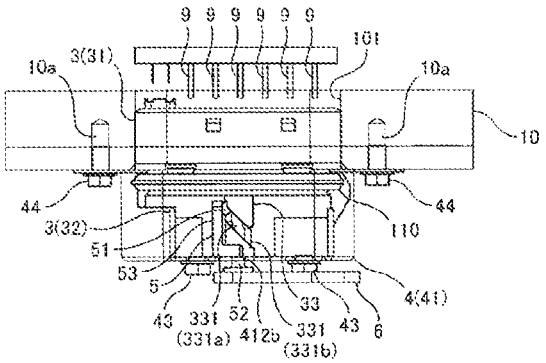
FIGS. 4A to 4C are views illustrating a mode of the connector under a condition where a housing (a cylindrical portion) is situated in a first position and the rotary member and a lever are situated in a first rotation position (connector non-fitted condition)
Figure 4B:
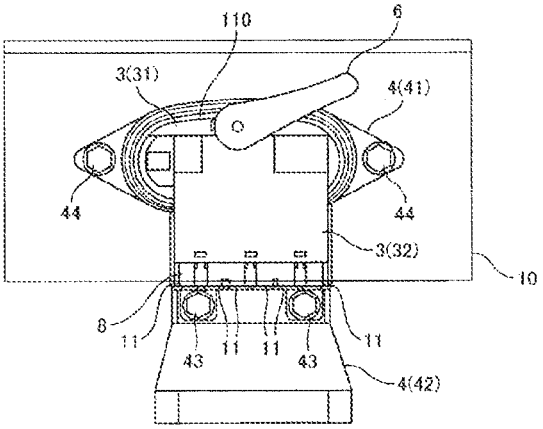
Figure 4C:
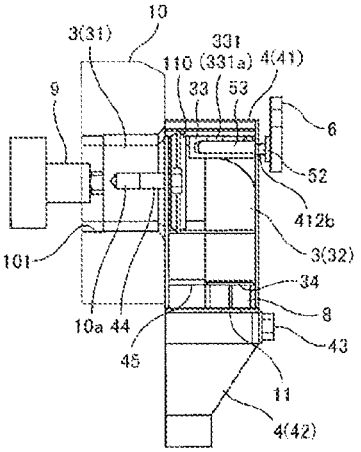
Figure 5A:
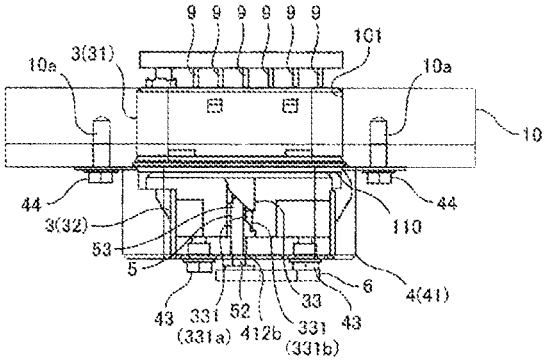
FIGS. 5A to 5C are views illustrating a mode of the connector under a condition where the housing (the cylindrical portion) is in the middle of moving from the first position to a second position and the rotary member and the lever are in the middle of moving from the first rotation position to a second rotation position (connector fitting condition)
Figure 5B:
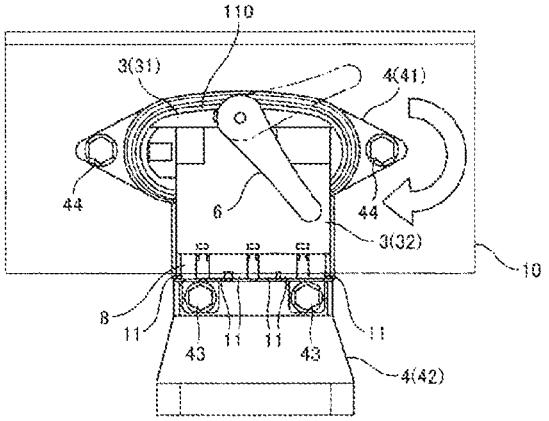
Figure 5C:
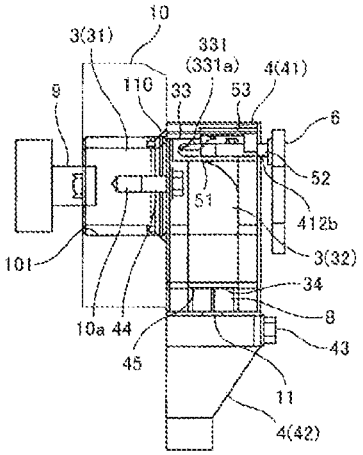
Figure 6A:
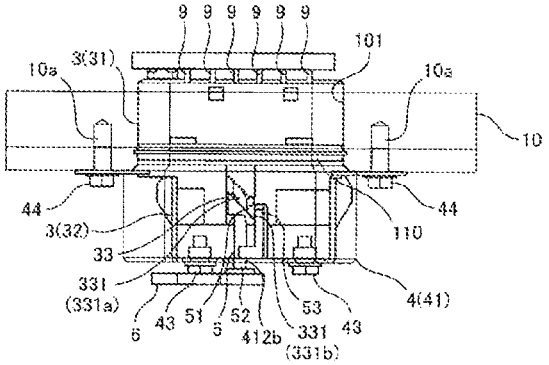
FIGS. 6A to 6C are views illustrating a mode of the connector under a condition where the housing (the cylindrical portion) is situated in the second position and the rotary member and the lever are situated in the second rotation position (connector fitted condition)
Figure 6B:
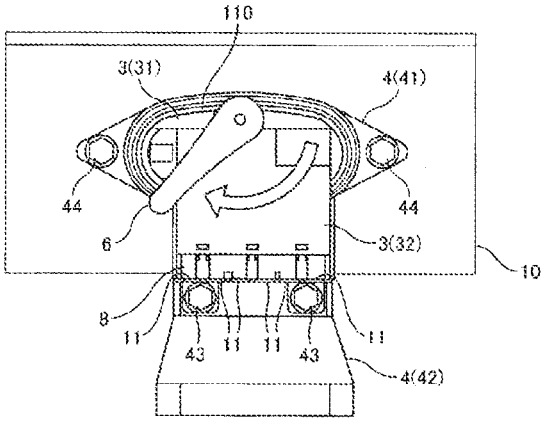
Figure 6C:
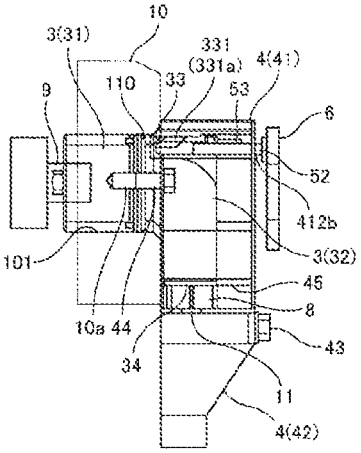

Now, the operations of the housing 3 (the cylindrical portion 33), the rotary member 5 and the lever 6 when the connector terminals 2 and the device terminals 9 are electrically connected in the connector 1 according to the present embodiment will be described with reference to FIG. 4A to FIG. 6C. FIGS. 4A to 4C illustrate a mode of the connector 1 under a condition where the housing 3 (the cylindrical portion 33) is situated in the first position and the rotary member 5 and the lever 6 are situated in the first rotation position (hereinafter, referred to as connector non-fitted condition), FIG. 4A is a view illustrating it from above, FIG. 4B is a view illustrating it from behind, and FIG. 4C is a view illustrating it from a side. FIGS. 5A to 5C illustrate a mode of the connector 1 under a condition where the housing 3 (the cylindrical portion 33) is in the middle of moving from the first position to the second position and the rotary member 5 and the lever 6 are in the middle of moving from the first rotation position to the second rotation position (hereinafter, referred to as connector fitting condition), FIG. 5A is a view illustrating it from above, FIG. 5B is a view illustrating it from behind, and FIG. 5C is a view illustrating it from a side. FIGS. 6A to 6C illustrate a mode of the connector 1 under a condition where the housing 3 (the cylindrical portion 33) is situated in the second position and the rotary member 5 and the lever 6 are situated in the second rotation position (hereinafter, referred to as connector fitted condition), FIG. 6A is a view illustrating it from above, FIG. 6B thereof is a view illustrating it from behind, and FIG. 6C thereof is a view illustrating it from a side. In order that the operation modes of the housing 3 (the cylindrical portion 33) and the rotary member 5 in the shield shell 4 can be confirmed, FIG. 4A to FIG. 6C illustrate the shield shell 4 and the connection counterpart side device 10 in a state of being partly transparent for convenience' sake.

When the connection counterpart side device 10 having the device terminals 9 and the connector 1 are fitted together, as illustrated in FIGS. 4A to 4C, the connector 1 where the housing 3 (the cylindrical portion 33), the rotary member 5 and the lever 6 are in the connector non-fitted condition is positioned and fixed to the connection counterpart side device 10. Specifically, the bolts 44 inserted in the through holes 414*a* of the flange portions 414 of the upper shield shell 41 are screwed into the screw holes 10*a* under a condition where the terminal accommodation portion 31 is accommodated in the hole portion 101, thereby assembling the shield shell 4 to the connection counterpart side device 10. Under this condition, the connector 1 and the connection counterpart side device 10 are not fitted together, the housing 3 is separate from the device terminals 9 together with the connector terminals 2, and the contact portions 21 of the connector terminals 2 are not in pressure contact with the device terminals 9. Moreover, the bosses 34 of the housing 3 abut against the rear ends (fixed ends) of the slits 45, thereby restricting the movement of the housing 3 (the connector terminals 2) further rearward from the first position (the retreat thereof from the device terminals 9).

When the lever 6 is normally rotated with respect to the shield shell 4 by applying a rotation force in the normal direction (the direction of the arrow illustrated in FIG. 5B) to the lever 6 from such a connector non-fitted condition, the rotary member 5 rotates normally with respect to the housing 3. Specifically, the arm portion 53 normally rotates around the rotation axis portion 52. Thereby, as illustrated in FIGS. 5A to 5C, the housing 3 (the cylindrical portion 33), the rotary member 5 and the lever 6 shift to the connector fitting condition. Under the connector fitting condition, the protrusion 51 relatively moves along the track groove 331*a* to move the housing 3 (the cylindrical portion 33) forward with respect to the shield shell 4. Since the shield shell 4 is positioned and fixed to the connection counterpart side device 10 under the connector non-fitted condition and is always held stationary, the housing 3 moves forward toward the device terminals 9 together with the connector terminals 2. In that case, since the rotation force acting on the track groove 331*a* from the protrusion 51 (plainly, from the rotary member 5 to the housing 3) is absorbed by the engagement between the bosses 34 and the slits 45, the housing 3 smoothly moves toward the device terminals 9 by the bosses 34 being guided along the slits 45, without rotating with respect to the shield shell 4.

Then, the lever 6 is further rotated normally with respect to the shield shell 4 (rotated in the direction of the arrow illustrated in FIG. 6B), and rotated until the connector fitted condition illustrated in FIGS. 6A to 6C is reached. When the connector fitted condition is reached, the protrusion 51 having relatively moved along the track groove 331*a* enters the restriction groove 331*b* from the track groove 331*a* and engages therewith to situate the housing 3 (the cylindrical portion 33) in the second position. At the time of the shift from the connector fitting condition to the connector fitted condition, the housing 3 (the connector terminals 2) moves further forward with respect to the shield shell 4, and the connector terminals 2 press the contact portions 21 against the device terminals 9 so as to be elastically deformed and in contact therewith. Thereby, the connector terminals 2 and the device terminals 9 can be electrically connected, so that the connection counterpart side device 10 and the connector 1 are in a state of being fitted together. Moreover, the protrusion 51 having entered the restriction groove 331*b* abuts against the groove wall of the restriction groove 331*b*, thereby restricting the advance and retreat of the housing 3 (the connector terminals 2) with respect to the device terminals 9. Thereby, the condition of the electric connection between the connector terminals 2 and the device terminals 9 (the condition of the pressure contact of the device terminals 9 by the contact portions 21) can be surely maintained.

By applying a rotation force in the reverse direction (the counterclockwise direction in FIG. 6A) to the lever 6 from the connector fitted condition to rotate the lever 6 reversely with respect to the shield shell 4 and shift the housing 3 (the cylindrical portion 33), the rotary member 5 and the lever 6 to the connector non-fitted condition, the housing 3 (the cylindrical portion 33) can be caused to retreat rearward with respect to the shield shell 4. Thereby, the housing 3 is separated from the device terminals 9 together with the connector terminals 2, so that the pressure contact of the contact portions 21 with the device terminals 9 can be released. Under this condition, the electric connection between the connector terminals 2 and the device terminals 9 is released, and the fitting between the connection counterpart side device 10 and the connector 1 is also released (the condition illustrated in FIGS. 4A to 4C).

As described above, according to the present embodiment, in electrically connecting the connector terminals 2 and the device terminals 9, after the shield shell 4 is fixed to the connection counterpart side device 10 and the connector 1 is positioned with respect to the connection counterpart side device 10, the rotary member 5 is rotated with the lever 6 by an external operation. Under a condition where the connector 1 is positioned and fixed to the connection counterpart side device 10 (the connector non-fitted condition), the contact portions 21 of the connector terminals 2 are not in pressure contact with the device terminals 9 (even if they are in contact, the contact is nothing to cause an excessive pressing load), and only by causing the connector terminals 2 to advance toward the device terminals 9 together with the housing 3 by the rotation of the lever 6 from this condition, the contact portions 21 can be brought into pressure contact with the device terminals 9. That is, since it is necessary only that the connector terminals 2 advance toward the device terminals 9 together with the housing 3 by the motion direction conversion mechanism S (the protrusion 51 and the helical groove 331), even when a plurality of terminals are connected together, no other connection members (a contact spring, etc.) than the connector terminals 2 and the device terminals 9 are required for each connection unit. This avoids the complication of the structure of connection between the terminals, and a plurality of terminals can be connected at a time by a single lever operation. Moreover, for example, it is unnecessary to temporarily insert the device terminals 9 into the connector terminals 2 (temporarily bring them into contact with the contact portions 21) (however, temporal insertion [temporal contact] is possible and is not excluded), and even when a plurality of terminals are connected together, the labor for such temporary insertion work and temporary contact work is never increased to be complicated in accordance with the number of terminals. Consequently, by using the connector 1 according to the present embodiment, even when a plurality of terminals are connected together, reduction in terminal insertion load and improvement in workability can be simultaneously achieved with a comparatively simple structure.

While the present invention is described above based on the embodiment as illustrated in FIG. 1 to FIG. 6C, the above-described embodiment is merely an example of the present invention, and the present invention is not limited only to the structure of the above-described embodiment. Therefore, it is obvious to one of ordinary skill in the art that the present invention may be carried out in modified or changed modes within the scope of the gist of the present invention, and it is to be noted that such modified or changed modes belong to the claims of the present application.

While the present invention has been described in detail and with reference to a specific embodiment, it is obvious to one of ordinary skill in the art that various changes and modifications may be added without departing from the spirit and scope of the present invention.

According to the present invention, an advantage is produced in that even when a plurality of terminals are connected together, reduction in terminal insertion load and improvement in workability can be simultaneously achieved with a comparatively simple structure. The present invention producing this advantage is useful for a connector for electrically connecting a plurality of terminals together.

What is claimed is:

1. A connector comprising:

a plurality of connector terminals having elastically deformable contact portions to be contacted with device terminals of a connection counterpart side device;

a housing to which the connector terminals are assembled;

a rotary member that is rotatable with respect to the housing by an external operation; and a motion direction conversion mechanism that converts a rotary motion of the rotary member to a linear motion to move the housing in a direction of a rotation axis of the rotary member and brings the contact portions of the connector terminals in pressure contact with the device terminals, wherein the housing includes a cylindrical portion which is concentric with the rotation axis of the rotary member, and wherein the motion direction conversion mechanism includes:

at least one protrusion formed on one of: an outer peripheral surface of the cylindrical portion, and the rotary member, wherein, in a case where the at least one protrusion is formed on the outer peripheral surface of the cylindrical portion, the at least one protrusion extends from the cylindrical portion away from a center of the cylindrical portion; and at least one helical groove configured to engage with the protrusion, the at least one helical groove being formed on the other of: the outer peripheral surface of the cylindrical portion, and the rotary member.

2. The connector according to claim 1, further comprising:

an exterior member that surrounds the housing and is fixed to the connection counterpart side device, wherein on one of the housing and the exterior member, a slit, linearly extending in the direction of the rotation axis, is formed, and on the other of the housing and the exterior member, a boss, configured to engage with the slit to restrict the movement of the housing in directions other than the direction of the rotation axis, is formed.

3. The connector according to claim 2, further comprising:

an operation member that is provided outside of the exterior member and that supports the rotary member so as to be rotatable around the rotation axis.

4. The connector according to claim 2, wherein the exterior member includes a shield shell that prevents external leakage of noise caused from the inside of the connector.

5. The connector according to claim 1, wherein the motion direction conversion mechanism includes:

the at least one protrusion formed on the rotary member; and the at least one helical groove formed on the outer peripheral surface of the cylindrical portion, wherein the rotary member includes a rotation axis portion configured to be inserted into an interior of the cylindrical portion, and an arm portion disposed outside of the cylindrical portion when the rotation axis portion is inserted into the cylindrical portion.

6. The connector according to claim 5, wherein the at least one protrusion extends from the arm portion toward the rotation axis portion of the rotary member.

* * * * *